US005857291A

United States Patent [19]

Headrick

[11] Patent Number: 5,857,291

[45] Date of Patent: Jan. 12, 1999

[54] ASTRAGAL WITH INTEGRAL SEALING LOCK BLOCK

[75] Inventor: J. Charles Headrick, Alpharetta, Ga.

[73] Assignee: Headrick Manufacturing Company, Cumming, Ga.

[21] Appl. No.: 773,726

[22] Filed: Dec. 20, 1996

[51] Int. Cl.[6] ..... E06B 7/16; E05C 1/04

[52] U.S. Cl. ..... 49/368; 49/369; 49/366; 292/42; 292/145

[58] Field of Search ..... 49/142, 366, 367, 49/368, 369, 371; 292/42, 145, 147; 160/40, 209

[56] References Cited

U.S. PATENT DOCUMENTS

| | | | |
|---|---|---|---|
| 3,432,966 | 3/1969 | Bordner | 49/368 |
| 3,649,060 | 3/1972 | Ruff | 292/42 |
| 3,888,046 | 6/1975 | Meisterheim | 49/366 |
| 4,052,819 | 10/1977 | Beischel et al. | 49/368 |
| 4,429,493 | 2/1984 | St. Aubin | 49/367 |
| 4,625,457 | 12/1986 | Avery | 49/366 |
| 4,644,696 | 2/1987 | Bursk | 49/367 |
| 5,165,740 | 11/1992 | Curnes et al. | 49/367 |
| 5,335,450 | 8/1994 | Procton | 49/368 |

*Primary Examiner*—Blair M. Johnson
*Assistant Examiner*—Curtis Cohen
*Attorney, Agent, or Firm*—Isaf Vaughan & Kerr

[57] ABSTRACT

An improved astragal assembly for use with a double door installation includes an astragal strip secured along the vertical edge of the inactive door. A lock block is slidably disposed in at least one end of said astragal strip and can be moved between an extended position for securing the door and a retracted position for freeing the door. The lock block has a projecting bolt receivable in a receptacle in the door frame when the lock block is slid to its extended position. A gasket is secured to the end of the lock block and the bolt passes through an opening in the gasket. The gasket engages and seals against the door frame when the lock block is in its extended position. Gaskets are also provided on the sides of the lock block for engaging and sealing against the doors of the double door installation. When the doors are closed and secured in place, the lock block and gasket assembly prevents drafts from flowing under the door installation beneath the astragal thereof.

15 Claims, 4 Drawing Sheets

ASTRAGAL WITH INTEGRAL SEALING LOCK BLOCK

TECHNICAL FIELD

This invention relates generally to double door installations and more specifically to astragal assemblies mounted along the vertical edge of the inactive door of such installations against which the active door closes.

BACKGROUND OF THE INVENTION

To seal the space between the opposed vertical edges of the active and inactive doors of a double door installation when the doors are closed, it is common to use a T-shaped astragal mounted along the vertical edge of the inactive door. Such astragals provide a stop against which the active door can close and usually include a weather strip that seals against the closed active door to prevent drafts. To secure the inactive door in its closed position, vertically slidable lock blocks are mounted in the top and bottom ends of the astragal. The lock blocks are formed with bolts that project from the ends of the lock blocks. The lock blocks are slidable between an extended position wherein their bolts project into receptacles in the door frame to secure the inactive door and retracted positions wherein the bolts are withdrawn into the astragal for freeing the inactive door. When the lock blocks are in their extended positions, the inactive door is locked and secured in its closed position. The active door can then be closed against the astragal of the inactive door. A common door knob can be provided in the active door and a corresponding strike plate can be mounted in the astragal along the vertical edge of the inactive door if desired for securing and locking the active door in its closed position.

Double door installations are normally sealed along the hinged edge portions of the doors, along the head jamb of the door frame, and along the astragal by appropriate flexible sealing members or weather strips that are attached to the jamb stops and that engage and compress against the doors when they are closed. The bottom edges of the doors typically are sealed against the door sill either by flexible sweeps secured to the bottom edges of the doors or by an upwardly projecting flexible threshold cap member that engages the bottoms of the doors when they are closed.

Since the jamb stops along the tops of the doors project slightly over the edges of the door faces to provide abutting surfaces for the doors, it is necessary to notch or recess slightly the top end of the astragal so that it does not interfere with the opening and closing of the doors by impacting the jamb stops. It is also necessary to provide a space between the bottom end of the astragal and the threshold cap of the sill for the same reason. The result is an air gap between the top end of the astragal and the head jamb and between the bottom end of the astragal and the door sill that can permit drafts and rain to enter the dwelling. Even though the bolts of the lock blocks extend through these gaps when the inactive door is secured, they do not completely fill the gaps and provide almost no seal against drafts and rain water.

Attempts to seal the gap between the astragal ends and the door frame and sill have been made in the past. U. S. Pat. No. 4,625,457 of Avery, for example, teaches the use of a rubber pad that is attached to the astragal end portions and that has laterally projecting flexible fingers that engage the bottom edge of the active door and the extended bolt of the inactive door when the doors are closed. While this provides some resistance to drafts and water entry on the sides of the gap, it does not seal the bottom of the gap because the pad is fixed to the astragal and a small space must still be provided between the strip and the door jamb and sill to allow opening and closing of the doors. This is a particular problem on the bottom of the astragal because threshold caps of door sills typically are not flat and the pad must be able to clear the highest point of the threshold cap. Thus, the Avery device falls short of providing a reliable seal.

U.S. Pat. No. 4,052,819 of Beischel, et al. teaches lock block having a projecting bolt and being provided on its opposed sides with bristled pads that bear against the edges of the doors. When the lock block is extended to secure the inactive door, the pads move with the block to bear against the door edges at their extreme lower extents and thus to seal the sides of the gap between the bottom of the astragal and the door sill. When in this position, the bottom of the lock block rests against the top of the threshold cap portion of the door sill. As with Avery the Beischel et al. device provides some seal on the sides of the gap but does not provide a seal at the bottom of the gap because the hard bottom surface of the lock block is the only thing that engages the sill. Further, since door frames and sills vary in size and the lock block's extent of travel is fixed, the bottom of the lock block rarely precisely contacts the sill when the lock block is extended and this results in a gap. In addition, for threshold caps that are not flat, the Beischel et al. device provides little if any resistance to drafts and rain water at the bottom of the gap.

U.S. Pat. No. 4,429,493 of St. Aubin teaches the application of a bristled pad to the top of the sill itself. The idea here is that the pad will contact the bottom of the astragal when the door is closed to seal the gap. However, this device fails to address the sealing of the gap on its sides and thus is an inadequate solution. Another device for sealing the gaps between the ends of an astragal and the door frame is disclosed in U.S. Pat. No. 4,644,696 of Bursk. The Bursk device also fails to provide a reliable seal against drafts and water.

Accordingly, there exists a need for a device that provides a reliable and complete seal of the entire gap between the ends of an astragal and a door frame and seal to prevent drafts from entering through the gaps and to prevent rain water from seeping into a dwelling through the gaps. It is to the provision of such a device that the present invention is primarily directed.

SUMMARY OF THE INVENTION

Briefly described, the present invention, in a preferred embodiment thereof, comprises an astragal assembly for use with a double door installation that includes an active door and an inactive door. The doors have substantially abutting generally vertical inside edge portions and bottom edge portions that overlie a sill when the doors are closed. The astragal assembly includes an elongated astragal strip having a bottom end and being securable to the inside edge portion of the inactive door extending substantially along the entire length thereof. The astragal strip is formed to define a stop extending along the length of the strip. A weather strip is provided along the stop for sealingly engaging the active door of the installation when the active door is closed against the stop.

In the preferred embodiment, the astragal is fabricated of extruded aluminum forming an internal channel and a vertically slidable lock block is mounted in the bottom end of the astragal strip. The lock block has a bottom end and a bolt projects downwardly from the bottom end of the lock block. The lock block is selectively slidable in the channel of the astragal strip between an extended position wherein the bolt extends into a receptacle in the sill for securing the inactive door and a retracted position wherein the bolt is retracted from the receptacle for freeing the inactive door.

A sealing member, such as a rubber gasket, is secured to the bottom end of the lock block and is formed with an opening through which the bolt of the lock block extends. Preferably, the bottom surface of the rubber gasket is contoured to conform to the shape of the underlying sill. A bristled or foam pad is secured to each of the opposed sides of the lock block and each pad extends from the bottom of the rubber gasket upwardly a distance at least equal to the height of the gap between the bottom of the doors and the sill. Preferably, the pads extend upwardly further than the height of the gap and the outside pad has a forward edge portion that underlies the weather stripping that extends along the length of the astragal strip.

In use, the inactive door of the double door installation is closed and the lock block is moved to its extended position to secure the door. As the lock block is extended, the bolt moves into the receptacle in the sill and the rubber gasket engages and compresses against the threshold cap portion of the sill. In this regard, the contoured bottom surface of the rubber gasket conforms to the shape of the threshold cap so that a complete and tight seal is created between the gasket and the sill. At the same time, the pads on the sides of the lock block extend upwardly from the sill and bear first against the ends of the rubber sweeps on the bottoms of the doors and then against the inside vertical edges of the doors themselves. Accordingly, a complete and unbroken seal is provided around the bottom and around the sides of the gap beneath the astragal. Drafts are effectively eliminated as is the seepage of water since the water is unable to travel beneath the rubber gasket or up and over the side pads of the lock block.

When it is desired to free the inactive door, the lock block is simply raised and the rubber gasket and pads move up out of the way so that they do not interfere with the normal opening and closing of the door. The same type of lock block assembly can also be provided at the top of the astragal if desired to seal the gap between the top of the astragal and the jamb header.

Accordingly, it is an object of this invention to provide an improved astragal assembly for use with a double door installation wherein a complete seal is provided in the gaps between the astragal ends and the door frame when the doors are shut and secured.

Another object of the invention is to provide an astragal gap seal that does not interfere with the normal operation of the doors of the installation when the seal is not in use.

A further object of the invention is to provide a lock block assembly for use with double door astragals that effectively seals the gaps between the astragal ends and the door frame and that is durable and reliable.

These and other objects, features, and advantages of this invention will become more apparent upon review of the detailed description set forth below when taken in conjunction with accompanying drawings, which are briefly described as follows.

DETAILED DESCRIPTION OF THE PREFERRED EMBODIMENTS

Figure 1:
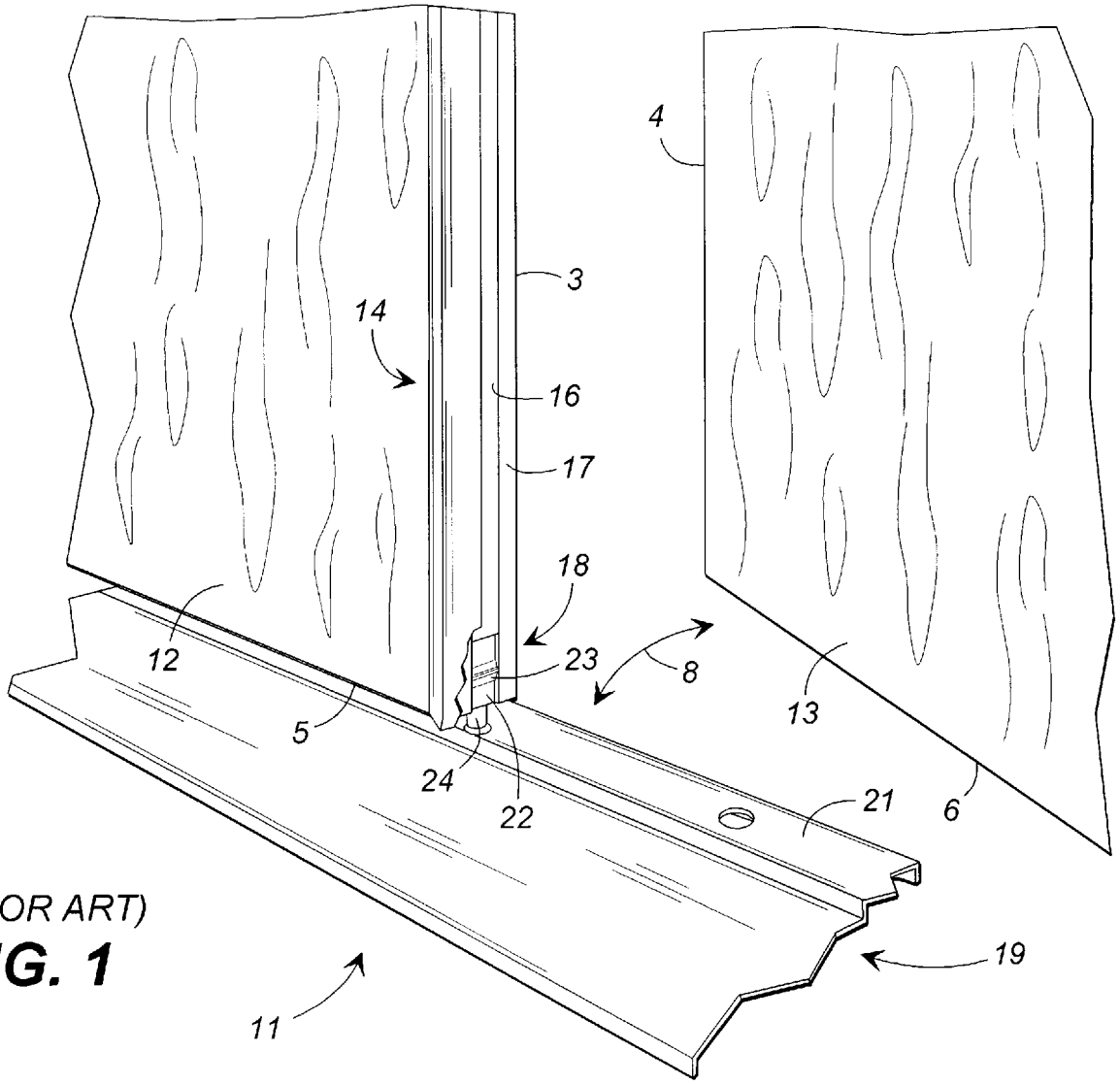
(PRIOR ART) FIG. 1
FIG. 1 illustrates a typical double door installation with an astragal assembly provided with a prior art lock block mechanism.

Referring now in more detail to the drawings, in which like reference numerals refer to like parts throughout the several views, FIG. 1 illustrates in a perspective partially cut away view a common double door installation provided with a prior art astragal assembly. The installation 11 includes an inactive door 12 that is normally secured in its closed position and an active door 13 that can be opened and closed freely for ingress and egress. The doors 12 and 13 have opposed vertically extending side edges 3 and 4 respectively and bottom edges 5 and 6. The bottom edges 5 and 6 normally overlie the threshold cap portion 21 of a door sill 19 when the doors are closed.

The bottom end portion 18 of the astragal strip 14 is provided with a lock block assembly 22 for securing the inactive door in its closed position. The lock block assembly 22 includes a lock block that is vertically slidably mounted in the astragal strip and is provided with a downwardly projecting bolt 24. The lock block is selectively slidable by means of a handle 23 between an extended position wherein the bolt protrudes from the bottom of the astragal and is received in a receptacle in the sill to secure the inactive door in a retracted position wherein the bolt is retracted from the receptacle for freeing the inactive door. The mechanical means for raising and lowering the lock block assembly can vary from manufacturer to manufacturer and the illustrated configuration should be considered only an example for purposed of discussion.

Figure 2:
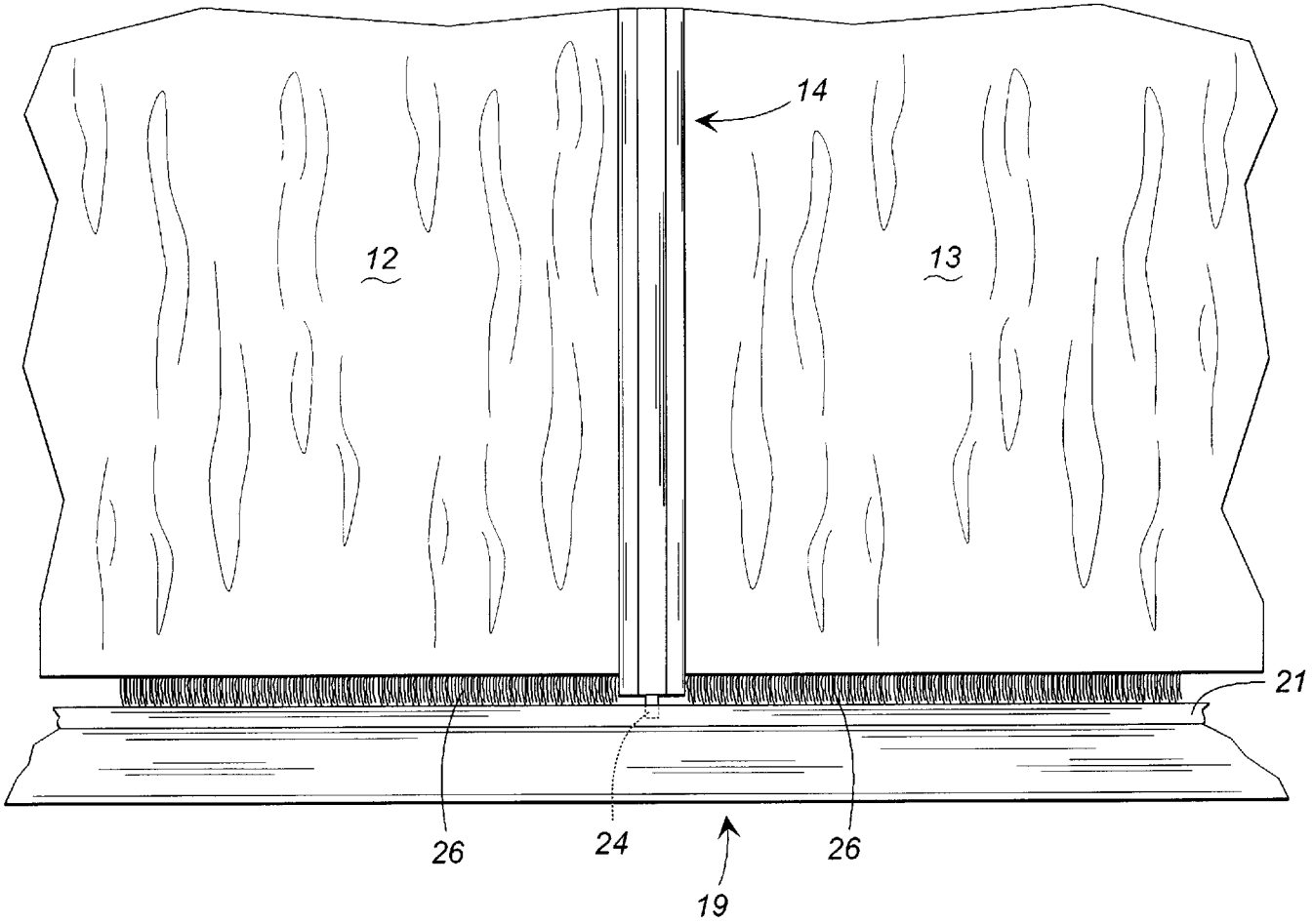
(PRIOR ART) FIG. 2
FIG. 2 is a front plan view of a prior art double door and astragal assembly illustrating the gap between the bottom of the astragal and the underlying door sill.

FIG. 2 is a front elevational view of the installation of FIG. 1 with the doors shown in their closed positions and illustrating the problem addressed by the present invention. Since the bottom of the astragal must clear the door sill when the inactive door is opened inwardly, there is provided a space between the bottom of the astragal and the top of the threshold cap portion of the door sill. The bolt 24 of the lock block assembly extends through this space into a receptacle in the door sill. In FIG. 2, the bottom edges of the doors are sealed against the threshold cap by flexible rubber sweeps 26 that are mounted to the bottoms of the doors and that bear against the threshold cap when the doors are closed. However, the sweeps extend only to the ends of the doors. This leaves the gap between the bottom of the astragal strip and the door sill open so that drafts can blow through the gap and rain water can seep through the gap.

Figure 3:
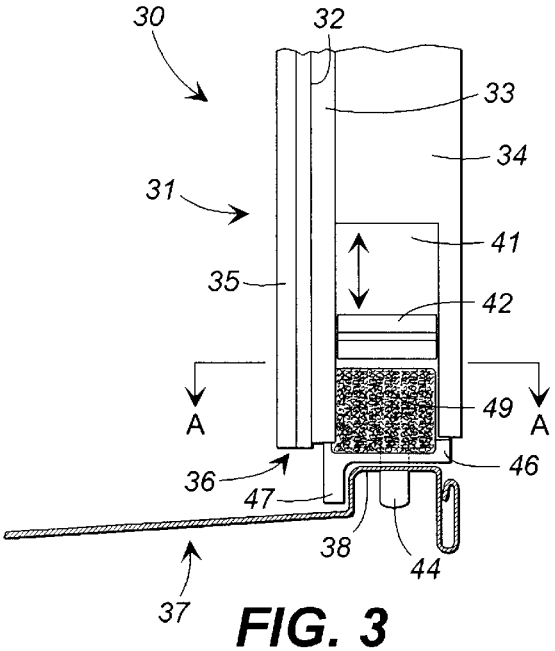
FIG. 3 is a side elevational view of the bottom portion of an astragal assembly that embodies principals of the present invention in a preferred form and that illustrates the lock block assembly in its lowered sealing position.
Figure 4:
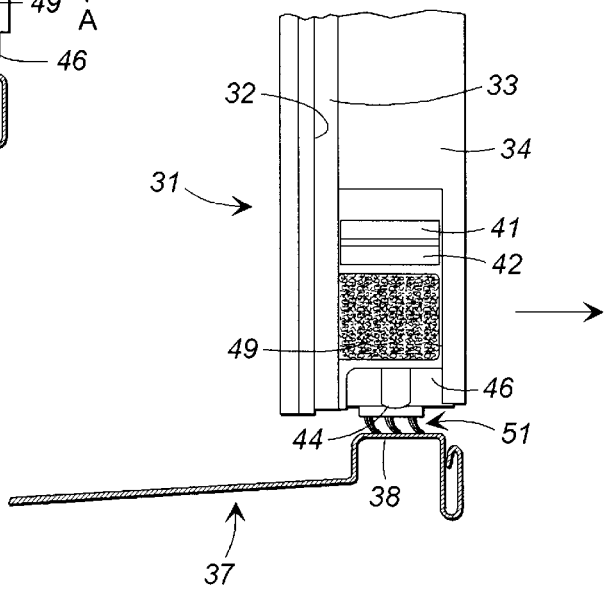
FIG. 4 is a side elevational view of the astragal assembly of FIG. 3 illustrating the lock block assembly in its raised position.
Figure 5:
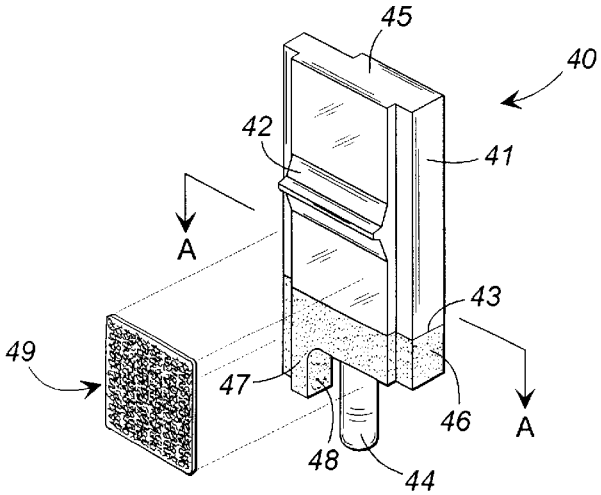
FIG. 5 is a perspective partially exploded view of a lock block assembly that embodies principals of the invention in a preferred form.

FIGS. 3 through 5 illustrate the unique astragal and lock block assembly of the present invention that, in use, completely seals the gap below the bottom of the astragal against drafts and rain water seepage. While the invention will be described below in terms of the lock block at the bottom of the astragal for sealing the gap there, it should be understood that the description is also applicable to a lock block assembly at the top of the astragal assembly for sealing the gap at the head jamb.

The astragal assembly 30 comprises an astragal strip 31 that can be secured along the vertical edge of the inactive door of a double door installation. The astragal strip 31 has an outside front portion 35 that is sufficiently wide to overlie partially the edge of the front face of each of the doors of the double door installation. In this way, the outside front portion of the astragal strip forms a stop 32 against which the active door can be closed. A flexible seal or weather strip 33 is provided along the length of the stop 32 for engaging and sealing against the active door when closed to prevent drafts and rainwater from entering along the opposed edges of the closed doors.

The astragal strip 31 is formed with a leg 34 that extends inwardly from the outside front portion 31 and that resides between the opposed vertical edges of the doors when they are closed. The astragal strip 31 is secured to the vertical edge of the inactive door with appropriate fasteners such as screws (not shown) that extend through the leg 34 and into the material of the inactive door. The leg 34 may also carry other functional elements of the double door installation such as strike plates for receiving the bolts of the door knob and/or dead bolt assemblies of the active door.

The bottom end of the leg 34 is formed to define a vertical channel for receiving the vertically slidable lock block assembly 40 of the present invention. In the preferred embodiment, the entire astragal strip is made of extruded aluminum and the vertical channel is integrally formed as a part of the extrusion. However, other astragal strip configurations and constructions, such as milled wooden strips, are possible and are contemplated to be within the scope of the present invention. The bottom end of the leg 34 is notched as shown in FIGS. 3 and 4 so that one face of the lock block assembly 40 is exposed through the notch for manual manipulation of the lock block assembly as detailed below.

As best illustrated in FIG. 5, the lock block assembly 40 comprises a lock block 41 that preferably is made of steel, hard plastic, or other resilient material.

Figure 7:
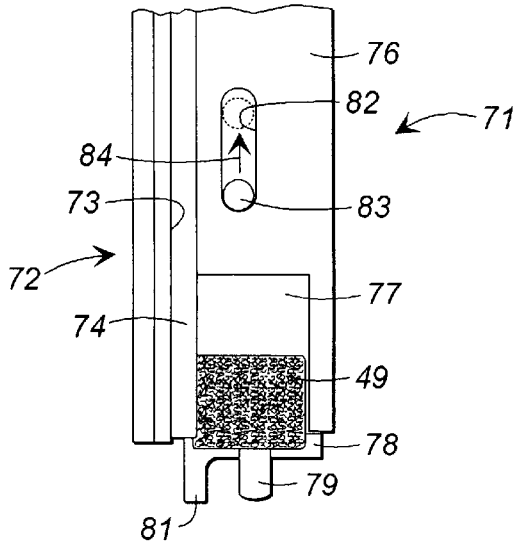
FIG. 7 is a side elevational view of an alternate embodiment of the astragal assembly of this invention illustrating an alternative mechnaism for raising and lowering the lock block.

The lock block 41 is contoured to fit and slide vertically within the channel of the astragal strip between an extended position (FIG. 3) and a retracted position (FIG. 4). In the preferred embodiment, the lock block 41 has shoulders that conform to the interior shape of the channel for this purpose. Clearly, however, other configurations might also be employed depending upon the shape of the channel in which the lock block 41 is disposed. The lock block 41 is also formed with a protruding handle or knob 42 that extends out through the notch in the astragal strip to provide a convenient means for manually manipulating the lock block assembly to slide it up or down in its channel as necessary. A simple protruding knob 42 is illustrated in FIGS. 3 through 5 for clarity and ease of description of the elements of the lock block assembly that form the present invention. However, a wide variety of handle and knob configurations for sliding the lock block assembly up and down are possible. One such alternate configuration is illustrated in FIG. 7. Other mechanisms such as lever assemblies might also be employed within the scope of the present invention. Therefore, the simple protruding knob illustrated in FIGS. 3 through 5 should not be interpreted as a limitation of the present invention and any mechanism for selectively moving the lock block up and down in its channel is contemplated by the invention.

The lock block 41 has a bottom surface, indicated by the line 43 in FIG. 5, and a top surface 45. A hardened metal blot 44 depends downwardly from the bottom surface 43 of the lock block 41. The bolt 44 can be formed integrally with the lock block if desired or it can be a separate specially treated or hardened element that is installed in the bottom of the lock block. In any event, the bolt projects downwardly and is sized and positioned to be received in a corresponding receptacle in the door sill to secure the inactive door in its closed position when the lock block assembly is slid to its extended position as illustrated in FIG. 3.

A gasket 46 is secured and extends downwardly from the bottom surface 43 of the lock block. The gasket preferably is formed of a relatively resilient but flexible material such as rubber, rubberized latex, or foam and is configured with a central bore or opening through which the bolt 44 extends. Preferably, the opening is slightly smaller than the blot. In this way, the gasket 46 tightly surrounds the bolt and the walls of the opening seal against the surface of the bolt to prevent drafts and water seepage between the gasket and the bolt.

As best illustrated in FIGS. 3 and 5, the gasket 46 is formed with a depending outside leg 47 that defines a generally L-shaped bottom surface of the gasket. The precise shape of the bottom surface of the gasket 46 is predetermined to correspond and conform to the shape of the threshold cap 38 of the door sill assembly 37 that underlies the double door installation. In this way, when the inactive door is closed and the lock block assembly is slid to its extended position, the bottom surface of the gasket 46 bears and seals against the threshold cap of the door sill across its width and also down its front side. This, in turn, forms a high integrity seal against the threshold cap that effectively eliminates drafts and water seepage between the bottom of the lock block assembly and the door sill.

A pad 49 is secured with an appropriate adhesive to the outside face of the lock block and can be a foam pad or a bristled pad or can be formed of another appropriate material. In the preferred embodiment, the pad is generally square or rectangular in shape and extends from the bottom of the gasket 46 upwardly to a preselected location on the lock block 41. In practice, the pad 49 extends upwardly a distance at least equal to and preferably greater than the distance between the bottoms of the doors of the installation and the top of the threshold cap of the sill assembly. The pad has a width that is slightly smaller than the width of the notch in the bottom of the leg 34 of the astragal assembly so that the pad protrudes through the notch. The outside or forward edge of the pad 49 preferably extends beneath the weather strip 33 at the bottom thereof.

Figure 6:
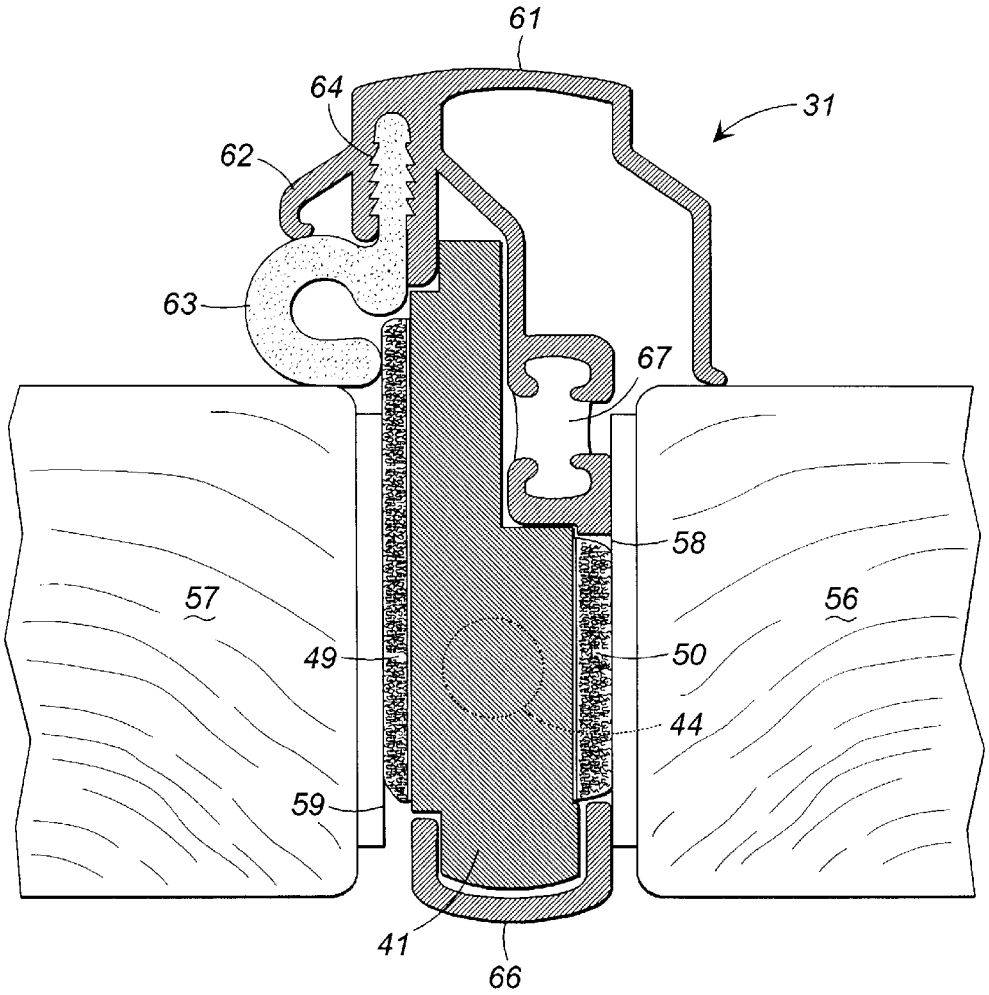
FIG. 6 is a cross-sectional view of the astragal assembly of this invention taken along line A—A of FIGS. 3 and 5.

As best illustrated in FIG. 6, a pad 50 similar to the pad 49 is secured to the other side of the lock block assembly and protrudes through a notch in the astragal strip to engage the vertical edge 58 of the inactive door when the astragal strip is attached to the door. The pad 50 also has a height that is greater than the distance between the door bottoms and the sill and is formed of an appropriate foam, bristled, or other material just as the pad 49.

Operation of the lock block assembly of this invention is best illustrated in FIGS. 3, 4 and 6. As shown in FIG. 4, the inactive door of the double door installation is provided with a flexible rubber sweep 51 that forms a seal between the bottom of the door and the sill when the door is closed. In the illustrated embodiment, the sweep has a number of flexible fingers that engage and bear against the top of the threshold cap of the sill; however, other types of sweeps are available. The sweep 51 extends substantially along the entire length of the bottom edge of the door and has an end that is coextensive with the vertical inside edge 58 of the inactive door.

In FIG. 4, the inactive door of the installation is seen to be closed with the lock block assembly in its retracted position and with the sweep 51 sealed against the top of the threshold cap 38. To secure the door, the lock block assembly 40 is slid manually to its extended position as shown in FIG. 3. In this position, the bolt 44 of the assembly extends into the appropriate receptacle of the sill assembly to secure the inactive door in its closed position. In addition, the bottom of the gasket bears and seals against the top of the threshold cap as described above.

The pad 50 extends upwardly from the threshold cap and bears first against the end of the sweep and then against the bottom of the vertical edge of the inactive door. In this way, the seal provided by the gasket against the threshold cap is extended continuously upwardly against the sweep and the door edge by the pad. Similarly, when the active door is closed against the astragal, the pad 49 extends upwardly from the threshold cap to bear first against the end of the sweep of the active door and then against the bottom of the vertical edge of the active door. Thus, when the doors are both closed, a continuous uninterupted seal is formed from the vertical edge of one door, against the end of its sweep, along the top of the threshold cap, up against the sweep of the other door, and finally against the inside edge of the other door. Accordingly, the space between the bottom of the astragal and the top of the threshold cap is completely sealed so that unwanted drafts and water seepage through this region are effectively eliminated. In addition, the pads 49 and 50 extend upwardly a sufficient distance to insure that rainwater is unable to move up and around the pads even in the event of a blowing rain. The contoured bottom surface of the gasket 46 can be formed to accommodate a threshold and sill assembly of any conventional shape to insure the integrity of the bottom seal even after long periods of use.

FIG. 6 is a cross-sectional view taken along line A—A of FIGS. 3 and 5 and illustrates the relationships of the various components of this invention. The astragal strip is seen to be formed of extruded aluminum and is provided with a thermal break 67 that helps prevent the portions 66 of the astragal exposed on the inside of the dwelling from becoming cold and sweating in the winter. A serrated slot 64 is formed in the extrusion 61 for receiving and holding the flexible weather strip 63 and a projecting arm 62 forms a stop and helps hold the weather strip in place against the active door. The lock block 41 is shown slidably positioned in the channel formed in the astragal strip with its pads 49 and 50 bearing against the vertical edges 58, 59 of the doors 56, 57 to form the seal described in detail above. While this is the preferred embodiment, other astragal shapes and lock block shapes might also be used. In fact, a wide variety of astragal shapes and designs might substituted for that shown in FIG. 6, which is presented as an example of the preferred embodiment only.

FIG. 7 illustrates an alternate embodiment of the lock block assembly of this invention wherein the lock block 77 is moved up and down, shown by arrow 84, in its channel by a knob 83 positioned within a slot 82 formed in the astragal strip. In this embodiment, the extent of travel of the lock block assembly is defined by the length of the slot 82. This embodiment has a like assembly to FIG. 5, which includes a stop 73 comprised of a weather strip 74, astragal leg 76, a gasket 78 including an outside leg 81, and a bolt 79. Various locking mechanisms can be employed if desired for releasably locking the knob 83 in is extended and retracted positions for securing and freeing the inactive door. In addition, a wide variety of mechanisms other than those shown in the drawings for extending and retracting the lock block assembly can be used. These mechanisms are well known to those of skill in the art and need not be described in detail here.

The invention has been described herein in terms of preferred embodiments and methodologies. It will be obvious to those of skill in the art, however, that various additions, deletions, and modifications might well be made to the illustrated embodiments without departing from the spirit and scope of the invention as set forth in the claims.

I claim:

1. An astragal assembly for use with a double door installation that includes an active door and an inactive door having substantially abutting generally vertical inside edge portions and having bottom edge portions that overlie a sill when the doors are closed, said astragal assembly comprising:

an elongated astragal strip having a bottom end and being securable to the inside edge portion of the inactive door extending substantially along the entire length thereof with said bottom end of said astragal strip being positionable adjacent the bottom edge portion of the inactive door;

stop means on said astragal strip extending substantially along the entire length thereof for engaging the active door when closed;

a vertically slidable lock block mounted in said bottom end of said astragal strip, said lock block having a bottom and a downwardly projecting bolt and being selectively slidable between an extended position for securing the inactive door and a retracted position for freeing the inactive door, said lock block having a first side and a second side said side being positionable such that the first side faces the vertical inside edge portion of the closed active door and the second side faces the vertical inside edge portion of the closed inactive door;

a sealing member secured to said bottom of said lock block surrounding said bolt, said sealing member being configured to conform at least partially to the shape of the sill and to seal against the sill when said lock block is in its extended position, said sealing means further having at least one downwardly extending leg;

a first pad fixed to said first side of said lock block and being sized and positioned to bear and seal against the vertical inside edge portion of the active door when the active door is closed; and a second pad fixed to said second side of said lock block and being sized and positioned to bear and seal against the vertical inside edge portion of the inactive door.

2. An astragal assembly as claimed in claim 1 and wherein said sealing member comprises a gasket secured to said bottom of said lock block, said gasket being formed with an opening through which said bolt extends.

3. An astragal assembly as claimed in claim 2 and wherein said gasket is formed of a rubberized material.

4. An astragal assembly as claimed in claim 2 and wherein said gasket is formed of a foam material.

5. An astragal assembly as claimed in claim 2 and wherein said gasket has a bottom surface and wherein said bottom surface of said gasket is contoured to conform at least partially to the shape of the underlying sill when the inactive door is closed.

6. An astragal assembly as claimed in cliam 5 and wherein the sill has a top surface and an outside edge and wherein said bottom surface of said gasket is formed with a first section positioned to seal against the top surface of the sill and a depending forward projection sized and positioned to extend over and seal against the outside edge of the sill when the inactive door is closed and said lock block is in its extended position.

7. An astragal assembly as claimed in claim 1 and wherein said pad is generally rectangular.

8. An astragal assembly as claimed in claim 7 and wherein said first pad is formed of a foam material.

9. An astragal assembly as claimed in claim 1 and wherein said first pad is formed of a bristled material.

10. An astragal assembly as claimed in claim 1 and wherein said gasket is co-extensive with said lock block and wherein said second pad extends from said bottom of said gasket to a persecuted position on said second side of said lock block.

11. An astragal assembly as claimed in claim 1 and wherein said astragal strip is fabricated of extruded aluminum having a longitudinal channel and wherein said lock block is slidably disposed in said channel at the bottom of said astragal strip.

12. A lock block assembly for slidable disposition in a double door installation wherein an active and an inactive door are mounted in a door frame, said lock block assembly being slidable between an extended position for securing the inactive door and a retracted position for freeing the inactive door, said lock block assembly comprising:

a body fabricated of resilient material and being shaped to be slidably disposed within a selected end of the inactive door, said body having two sides and an end;

a bolt projecting from said end of said body, said bolt being sized and positioned to extend into a receptacle in the door frame to secure the inactive door when said lock block assembly is slid to its extended position;

a first gasket secured to said end of said body, said first gasket being formed with an opening through which said bolt extends and being sized and configured to engage and seal against the door frame when said lock block assembly is slid to its extended position;

a second gasket secured to one of said sides of said body and being sized and positioned to bear and seal against the active door when the active door is closed; and a third gasket secured to the other one of said sides of said body and being sized and positioned to bear and seal against the inactive door.

13. A lock block assembly as claimed in claim 12 and wherein said first gasket has a bottom and wherein said second gasket extends from the bottom of said first gasket to a preselected location on said side of said body.

14. A lock block assembly as claimed in claim 12 and wherein the inactive door is provided with a weather strip extending along the length thereof for engaging and sealing against the active door when the active door is closed against the inactive door and wherein said second gasket extends at least partially beneath the weather strip.

15. A lock block assembly as claimed in claim 12 and wherein said first gasket is contoured to conform to at least a portion of the door frame when said lock block assembly is slid to its extended position.

* * * * *